US012031341B2

(12) United States Patent
Itagaki et al.

(10) Patent No.: US 12,031,341 B2
(45) Date of Patent: Jul. 9, 2024

(54) BINDING MACHINE

(71) Applicant: MAX CO., LTD., Tokyo (JP)

(72) Inventors: Osamu Itagaki, Tokyo (JP); Shinpei Sugihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 17/707,190

(22) Filed: Mar. 29, 2022

(65) Prior Publication Data

US 2022/0316223 A1 Oct. 6, 2022

(30) Foreign Application Priority Data

Mar. 31, 2021 (JP) ..... 2021-060574

(51) Int. Cl.
*E04G 21/12* (2006.01)

(52) U.S. Cl.
CPC ..... *E04G 21/123* (2013.01)

(58) Field of Classification Search
CPC ..... B21F 15/02; B21F 15/04; E04G 21/122; E04G 21/123; B65B 13/025; B65B 13/285; B65B 13/04; B65B 13/08; B65B 13/14
See application file for complete search history.

(56) References Cited

U.S. PATENT DOCUMENTS 4,117,872 A 10/1978 Gott et al.
4,362,192 A * 12/1982 Furlong ..... E04G 21/123 140/93.6
2004/0244866 A1 12/2004 Ishikawa et al.
2018/0207710 A1* 7/2018 Itagaki ..... B65B 13/285

FOREIGN PATENT DOCUMENTS

JP H06-190482 A 7/1994
JP 06190482 * 12/1994 ..... B21F 15/06
JP 2003-034305 A 2/2003

OTHER PUBLICATIONS

Machine Translation of JP 06190482A (Year: 1994).*
Extended European Search Report dated Aug. 26, 2022, issued by the European Patent Office in the corresponding European Patent Application No. 22165732.3. (7 pages).

* cited by examiner

*Primary Examiner* — Debra M Sullivan
(74) *Attorney, Agent, or Firm* — Banner & Witcoff, Ltd.

(57) ABSTRACT

A binding machine includes a wire feeding unit, a curl forming unit, a cutting unit, and a binding unit. The wire feeding unit includes a feeding member having a part that is in contact with the wire and configured to feed the wire with being displaced along a feeding direction of the wire. An amount of contact between the feeding member and the wire is switched in accordance with the feeding direction of the wire. As compared to the amount of contact in an operation of feeding the wire in one direction, the amount of contact in an operation of feeding the wire in other direction, which is opposite to the one direction, is made larger.

11 Claims, 10 Drawing Sheets

BINDING MACHINE

CROSS-REFERENCE TO RELATED APPLICATION(S)

This application is based on and claims priority under 35 USC § 119 from Japanese Patent Application No. 2021-060574 filed on Mar. 31, 2021, the contents of which are incorporated herein by reference.

TECHNICAL FIELD

The present invention relates to a binding machine configured to bind a to-be-bound object such as a reinforcing bar with a wire.

BACKGROUND ART

For concrete buildings, reinforcing bars are used so as to improve strength. The reinforcing bars are bound with wires so that the reinforcing bars do not deviate from predetermined positions during concrete placement.

In the related art, suggested is a binding machine referred to as a reinforcing bar binding machine configured to wind a wire on two or more reinforcing bars and to twist the wire wound on the reinforcing bars, thereby binding the two or more reinforcing bars with the wire.

When binding the reinforcing bars with the wire, if the binding is loosened, the reinforcing bars deviate from each other, so that it is required to firmly hold the reinforcing bars together. Therefore, as for a binding machine configured to wind a wire around a reinforcing bar and to twist the wire to thereby bind the reinforcing bar, suggested is a binding machine configured to pull back a surplus of a wire for improvement on a binding force (for example, refer to PTL 1).

CITATION LIST

Patent Literature

PTL 1: JP2003-034305A

When pulling back the surplus of the wire, it is necessary to pull back the wire with a strong force so as to remove the loosening due to the surplus of the wire. In order to pull back the wire with a strong force, for example, in a case of a configuration where the wire is fed sandwiched between a pair of feeding members, it is necessary to increase a force for pressing the feeding members against the wire.

However, even when feeding the wire in a forward direction in which the wire is wound around the reinforcing bar, a load applied to the wire increases, so that a feeding speed of the wire decreases. In addition, if the wire is fed in the forward direction with an unnecessarily strong force, the wire may buckle on the way.

SUMMARY

The present invention has been made to solve such problems, and an object of the present invention is to provide a binding machine configured to apply an appropriate load at a time of pulling back a wire.

In order to achieve the above object, the present invention provides a binding machine including a wire feeding unit configured to feed a wire; a curl forming unit configured to form a path along which the wire fed by the wire feeding unit is to be wound around a to-be-bound object; a cutting unit configured to cut the wire wound on the to-be-bound object; and a binding unit configured to twist the wire wound on the to-be-bound object and cut by the cutting unit, wherein the wire feeding unit includes a feeding member having a part that is in contact with the wire and configured to feed the wire with being displaced along a feeding direction of the wire, wherein an amount of contact between the feeding member and the wire is switched in accordance with the feeding direction of the wire, and wherein, as compared to the amount of contact between the feeding member and the wire in an operation of feeding the wire in one direction and winding the wire around the to-be-bound object, the amount of contact between the feeding member and the wire in an operation of feeding the wire in other direction, which is opposite to the one direction, and winding the wire on the to-be-bound object is made larger.

DESCRIPTION OF EMBODIMENTS

Hereinafter, an example of a reinforcing bar binding machine as an embodiment of the binding machine of the present invention will be described with reference to the drawings.

Figure 1A:
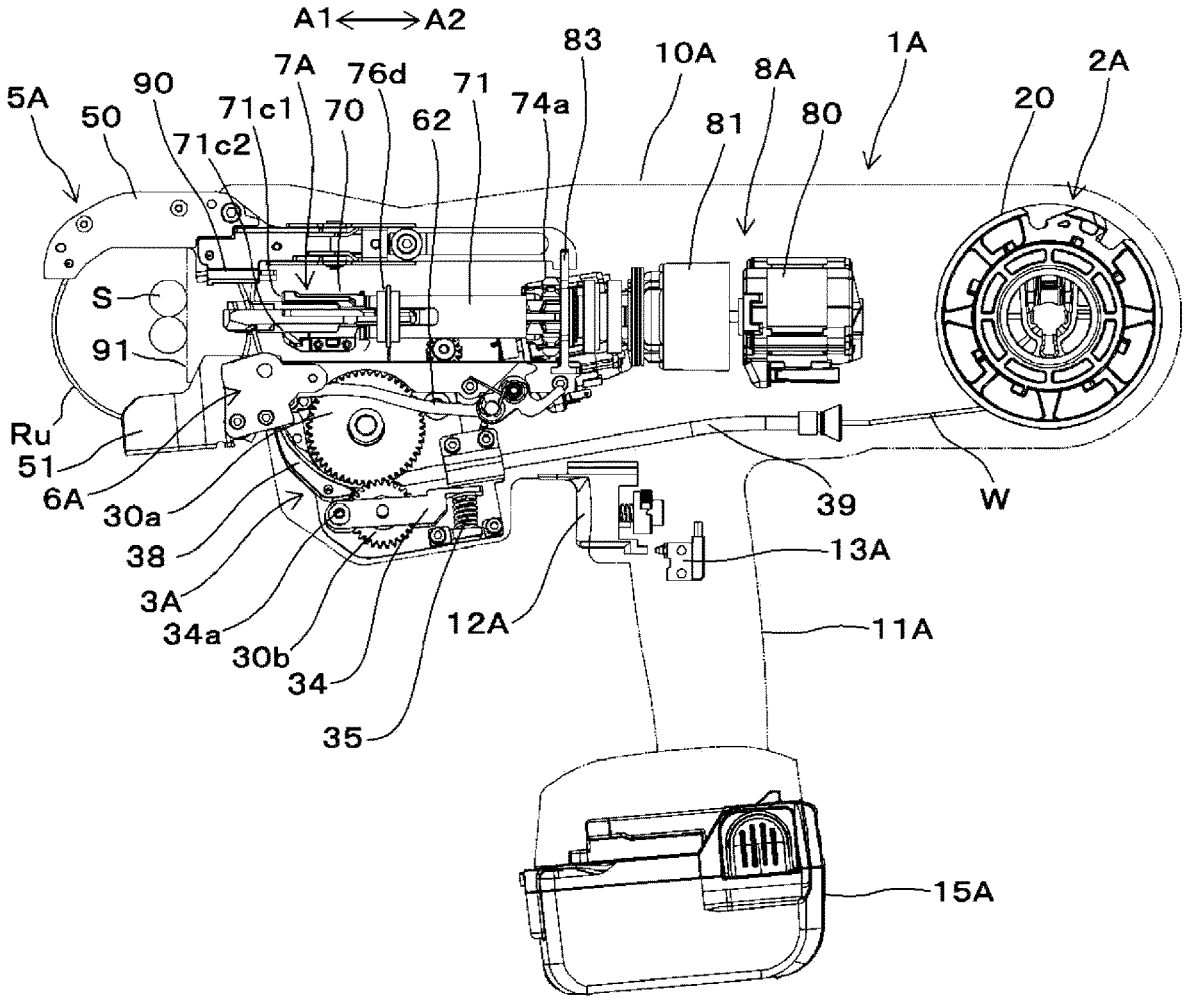
FIG. 1A is an internal configuration view showing an example of an overall configuration of a reinforcing bar binding machine of the present embodiment, as seen from a side.
Figure 1B:
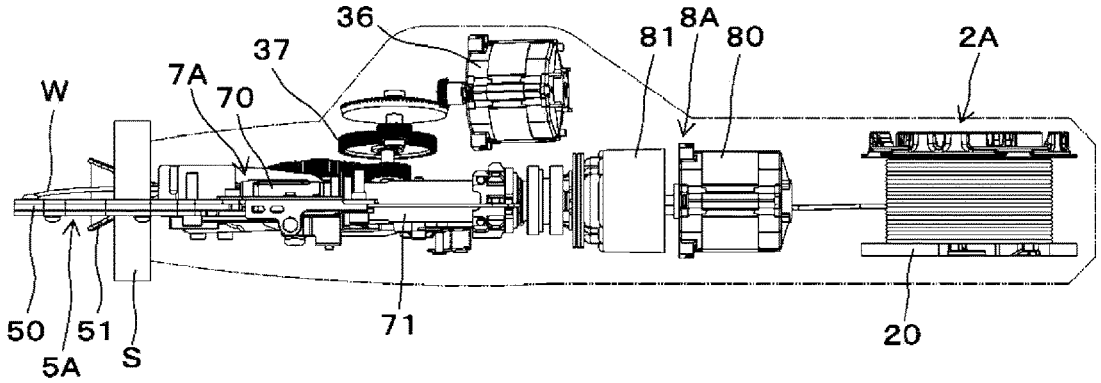
FIG. 1B is the internal configuration view showing the example of the overall configuration of the reinforcing bar binding machine of the present embodiment, as seen from above.

Configuration Example of Reinforcing Bar Binding Machine of Present Embodiment FIG. 1A is an internal configuration view showing an example of an overall configuration of a reinforcing bar binding machine of the present embodiment, as seen from a side, and FIG. 1B is the internal configuration view showing the example of the overall configuration of the reinforcing bar binding machine of the present embodiment, as seen from above.

A reinforcing bar binding machine 1A is configured to feed a wire W in a forward direction denoted with an arrow F, to wind the wire around reinforcing bars S, which are to-be-bound objects, to feed the wire W wound around the reinforcing bars S in a reverse direction denoted with an arrow R, to wind the wire on the reinforcing bars S, and to twist the wire W, thereby binding the reinforcing bars S with the wire W.

The reinforcing bar binding machine 1A includes a magazine 2A in which the wire W is accommodated, and a wire feeding unit 3A configured to feed the wire W, so as to implement the above-described functions. In addition, the reinforcing bar binding machine 1A includes a curl forming unit 5A configured to form a path along which the wire W fed by the wire feeding unit 3A is to be wound around the reinforcing bars S, and a cutting unit 6A configured to cut the wire W wound on the reinforcing bars S. Further, the reinforcing bar binding machine 1A includes a binding unit 7A configured to twist the wire W wound on the reinforcing bars S, and a drive unit 8A configured to drive the binding unit 7A.

The reinforcing bar binding machine 1A has such a form that an operator grips and uses with a hand, and has a main body part 10A and a handle part 11A. In the reinforcing bar binding machine 1A, a side of the main body part 10A on which the curl forming unit 5A is provided is referred to as 'front side', and a side on which the handle part 11A, which is gripped by an operator's hand, is provided is referred to as 'lower side'.

The magazine 2A is an example of the accommodation unit, and is provided on a rear side that is an opposite side to the front side of the main body part 10A on which the curl forming unit 5A is provided. In the magazine 2A, a reel 20 on which the long wire W is wound to be reeled out is rotatably and detachably accommodated. For the wire W, a wire made of a plastically deformable metal wire, a wire having a metal wire covered with a resin, or a twisted wire is used. The reel 20 is configured such that one or more wires W are wound on a hub part (not shown) and can be reeled out from the reel 20 at the same time.

The wire feeding unit 3A includes a pair of feeding gears 30*a* and 30*b* configured to sandwich and feed the wire W. Although details of the wire feeding unit 3A will be described later, rotation directions of the feeding gears 30*a* and 30*b* are switched, so that a feeding direction of the wire W is switched between forward and reverse directions.

The curl forming unit 5A includes, on the front side of the main body part 10A, a curl guide 50 configured to curl the wire W that is fed by the wire feeding unit 3A, and an induction guide 51 configured to guide the wire W curled by the curl guide 50 toward the binding unit 7A. In the reinforcing bar binding machine 1A, the path of the wire W that is fed by the wire feeding unit 3A is regulated by the curl forming unit 5A, so that a locus of the wire W becomes a loop Ru as shown in FIG. 1A and the wire W is thus wound around the reinforcing bars S.

The cutting unit 6A includes a movable blade part configured to cut the wire W in cooperation with a fixed blade part (not shown), and a transmission mechanism 62 configured to transmit an operation of the binding unit 7A to the movable blade part. The transmission mechanism 62 is configured to transmit an operation of the binding unit 7A to the movable blade part (not shown) via a movable member 83 and to actuate the movable blade part in conjunction with the operation of the binding unit 7A, thereby cutting the wire W.

The binding unit 7A includes a wire engaging body 70 to which the wire W is engaged. The drive unit 8A includes a motor 80, and a decelerator 81 configured to perform deceleration and amplification of torque.

The reinforcing bar binding machine 1A includes a feeding regulation part 90 against which a tip end of the wire W is butted, on a feeding path of the wire W that is engaged by the wire engaging body 70. In addition, in the reinforcing bar binding machine 1A, the curl guide 50 and the induction guide 51 of the curl forming unit 5A are provided at an end portion on the front side of the main body part 10A. Further, in the reinforcing bar binding machine 1A, a butting part 91 against which the reinforcing bars S are to be butted is provided at the end portion on the front side of the main body part 10A and between the curl guide 50 and the induction guide 51.

Further, in the reinforcing bar binding machine 1A, the handle part 11A extends downwardly from the main body part 10A, and a battery 15A is detachably mounted to a lower part of the handle part 11A. In the main body part 10A of the reinforcing bar binding machine 1A, the wire feeding unit 3A, the cutting unit 6A, the binding unit 7A, and the drive unit 8A are accommodated.

In the reinforcing bar binding machine 1A, a trigger 12A is provided on a front side of the handle part 11A, and a switch 13A is provided inside the handle part 11A. The reinforcing bar binding machine 1A is configured so that a control unit (not shown) controls the motor 80 and a feeding motor 36 according to a state of the switch 13A pushed as a result of an operation on the trigger 12A.

Figure 2A:
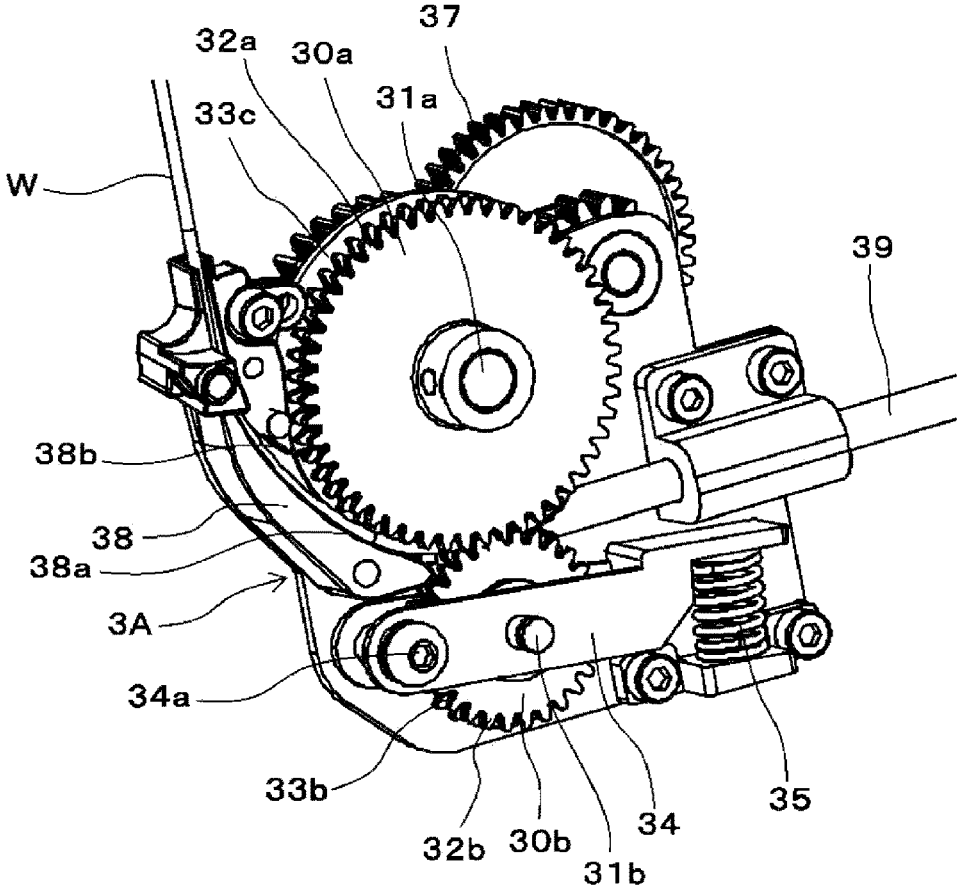
FIG. 2A is a perspective view showing an example of a wire feeding unit of the present embodiment.
Figure 2B:
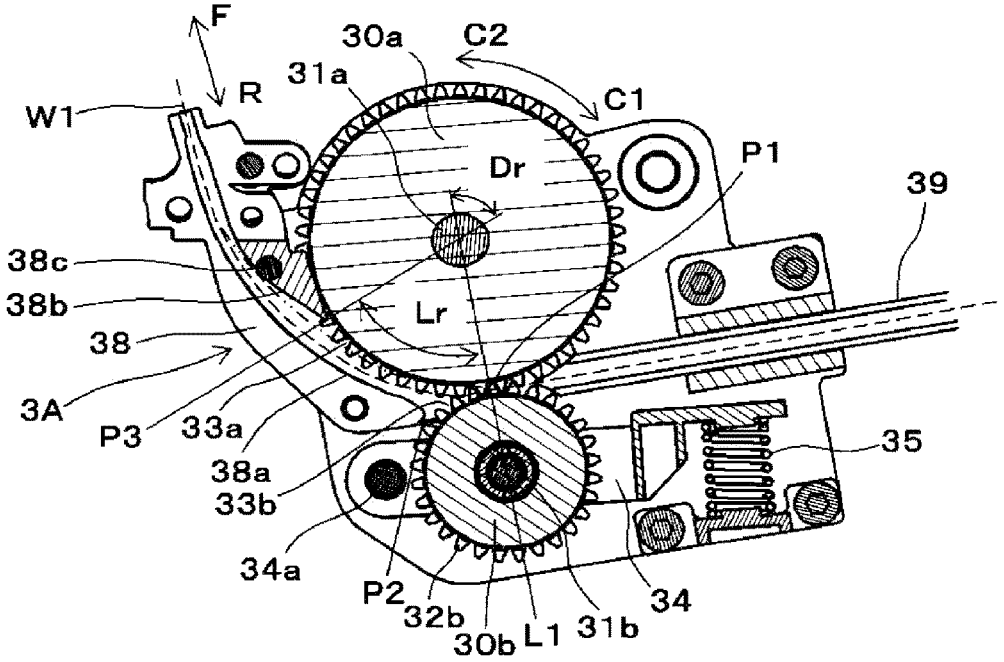
FIG. 2B is a side cross-sectional view showing the example of the wire feeding unit of the present embodiment.

FIG. 2A is a perspective view showing an example of the wire feeding unit of the present embodiment, and FIG. 2B is a side cross-sectional view showing the example of the wire feeding unit of the present embodiment. In the below, details of the wire feeding unit 3A are described with reference to the respective drawings.

The wire feeding unit 3A includes a pair of feeding gears 30*a* and 30*b* configured to sandwich and feed one or a plurality of wires W aligned in parallel. In the following example, a case where one wire W is fed is described.

The feeding gear 30*a* is an example of the feeding member, and has a spur gear-shaped gear portion 32*a* on an outer periphery of a disk shape configured to rotate about a shaft 31*a* as a fulcrum. In addition, the feeding gear 30*a* has a groove portion 33*a* provided near a center of the gear portion 32*a* along a thickness direction and continuous along a circumferential direction. The groove portion 33*a* has a V-shaped cross section along the thickness direction of the gear portion 32*a* seen from a direction along the circumferential direction, and two opposing surfaces thereof are in contact with the wire W.

The feeding gear 30*b* is an example of the feeding member, and has a spur gear-shaped gear portion 32*b* on an outer periphery of a disk shape configured to rotate about a shaft 31*b* as a fulcrum. In addition, the feeding gear 30*b* has a groove portion 33*b* provided near a center of the gear portion 32*b* along a thickness direction and continuous along a circumferential direction. The groove portion 33*b* has a V-shaped cross section along the thickness direction of the gear portion 32*b* seen from a direction along the circumferential direction, and two opposing surfaces thereof are in contact with the wire W.

The feeding gear 30*a* and the feeding gear 30*b* are provided to face each other with a feeding path W1 of the wire W being interposed therebetween and their axis directions being parallel to each other, and the gear portion 32*a* of the feeding gear 30*a* and the gear portion 32*b* of the feeding gear 30*b* are in mesh with each other. In addition, the groove portion 33*a* of the feeding gear 30*a* and the groove portion 33*b* of the feeding gear 30*b* face each other in a parallel direction.

The wire feeding unit 3A has a support member 34 configured to support the feeding gear 30*b* so as to be movable in directions of contacting and separating from the feeding gear 30*a*, and a spring 35 for urging the feeding gear 30*b* toward the feeding gear 30*a* via the support member 34.

One end portion of the support member 34 is rotatably supported by a shaft 34*a*, and the other end portion is urged by the spring 35. In addition, the support member 34 is configured such that the shaft 31*b* of the feeding gear 30*b* is provided between the shaft 34*a* and the spring 35 and the feeding gear 30*b* is rotatably supported.

Thereby, the wire feeding unit 3A is configured such that in a rotating operation of the support member 34 with the shaft 34*a* as a fulcrum, the feeding gear 30*b* moves in the directions of contacting and separating from the feeding gear 30*a* and the feeding gear 30*b* is urged toward the feeding gear 30*a* by the spring 35. In addition, the wire feeding unit 3A is configured such that the feeding gear 30*b* is urged toward the feeding gear 30*a* by the spring 35, so that the wire W is sandwiched between the groove portion 33*a* of the feeding gear 30*a* and the groove portion 33*b* of the feeding gear 30*b*.

The wire feeding unit 3A includes a feeding motor 36 configured to drive the feeding gear 30*a*, and a plurality of transmission gears 37 configured to transmit a drive force to the feeding gear 30*a*. The wire feeding unit 3A is configured such that, when the feeding gear 30*a* is driven and rotated by the feeding motor 36, the gears are engaged with each other, and accordingly, the feeding gear 30*b* is driven to rotate.

The wire W sandwiched between the groove portion 33*a* of the feeding gear 30*a* and the groove portion 33*b* of the feeding gear 30*b* comes into contact with a part of a surface along the circumferential direction of the groove portion 33*a* of the feeding gear 30*a* and a part of a surface along the circumferential direction of the groove portion 33*b* of the feeding gear 30*b*.

The feeding gear 30*a* is configured such that, in operations of rotating in a forward direction denoted with an arrow C1 and a reverse direction denoted with an arrow C2, a part of the groove portion 33*a* in contact with the wire W is displaced in the circumferential direction. Thereby, the wire feeding unit 3A is configured such that, when the feeding gear 30*a* and the feeding gear 30*b* rotate, the wire W sandwiched between the groove portion 33*a* of the feeding gear 30*a* and the groove portion 33*b* of the feeding gear 30*b* is fed in a forward direction, which is one direction denoted with an arrow F, or in a reverse direction, which is the other direction denoted with an arrow R, in accordance with the rotation direction of the feeding gear 30*a*.

As shown in FIG. 1A, in the reinforcing bar binding machine 1A, a feeding path of the wire W from the magazine 2A provided on the rear side of the main body part 10A to the wire feeding unit 3A extends in a front and rear direction. A guide member 39 having, for example, a cylindrical shape and configured to guide the wire W is provided between the magazine 2A and the wire feeding unit 3A.

In addition, in the reinforcing bar binding machine 1A, a feeding path of the wire W from the wire feeding unit 3A to the cutting unit 6A, the binding unit 7A and the curl guide 50 of the curl forming unit 5A provided on the front side of the main body part 10A extends in an upper and lower direction. As shown in FIGS. 2A and 2B, the feeding path W1 of the wire W is bent at the wire feeding unit 3A.

The feeding gear 30*a* is arranged on an inner side, which is a bending center-side of the feeding path of the wire W bent at the wire feeding unit 3A, and is configured to have a larger diameter than the feeding gear 30*b*.

A meshing portion P1 at which the gear portion 32*a* of the feeding gear 30*a* and the gear portion 32*b* of the feeding gear 30*b* mesh with each other is on a straight line L1 connecting the shaft 31*a* of the feeding gear 30*a* and the shaft 31*b* of the feeding gear 30*b*. The feeding gear 30*a* and the feeding gear 30*b* are provided such that a tangential line at the meshing portion P1 is orthogonal to the straight line L1 connecting the shaft 31*a* of the feeding gear 30*a* and the shaft 31*b* of the feeding gear 30*b*.

Thereby, on the feeding path W1 of the wire W, the wire W is sandwiched at the meshing portion P1, between the groove portion 33*a* of the feeding gear 30*a* and the groove portion 33*b* of the feeding gear 30*b*.

The wire feeding unit 3A includes a wire guide 38 configured to bend the feeding path W1 of the wire W along the feeding gear 30*a* and to control an amount of displacement of the wire W that is displaced in the directions of contacting and separating from the feeding gear 30*a*. The wire guide 38 is provided downstream of the meshing portion P1 of the feeding gear 30*a* and the feeding gear 30*b* with respect to the feeding direction of the wire W in the forward direction denoted with the arrow F.

The wire guide 38 has a first guide surface 38*a* that faces the feeding gear 30*a* on the downstream side of the meshing portion P1 with respect to the feeding direction of the wire W in the forward direction denoted with the arrow F. The first guide surface 38*a* has a shape concavely curved along the outer periphery of the gear portion 32*a* of the feeding gear 30*a*, and is provided at a position at a predetermined interval from the outer periphery of the gear portion 32*a*.

In addition, the wire guide 38 has a second guide surface 38*b* on a downstream side at a predetermined interval from the meshing portion P1 of the feeding gear 30*a* and the feeding gear 30*b* and on a downstream side of a start point portion P2 of the first guide surface 38*a* with respect to the feeding direction of the wire W in the forward direction denoted with the arrow F. The second guide surface 38*b* is an example of the regulation part, is provided at a position where a start point portion P3 of the second guide surface 38*b* enters the groove portion 33*a* of the feeding gear 30*a*, and faces the first guide surface 38*a* in a state where a gap through which the wire W passes and can move in a radial direction of the feeding gear 30*a* is provided between the first guide surface 38*a* and the second guide surface 38*b*. In addition, the wire guide 38 has a wear prevention member 38*c* provided on the second guide surface 38*b*. The wear prevention member 38*c* is made of a material harder than a material constituting the second guide surface 38*b*, and is provided by, for example, a columnar member exposing a part of an outer peripheral surface to the second guide surface 38*b*. The wear prevention member 38*c* is configured to suppress the wear of the second guide surface 38*b*, which is caused as the wire W slides along the second guide surface 38*b* in an operation of feeding the wire W in the reverse direction denoted with the arrow R.

Thereby, the feeding path W1 of the wire W is bent along an outer shape of the feeding gear 30*a* on the downstream side of the meshing portion P1 of the feeding gear 30*a* and the feeding gear 30*b* with respect to the feeding direction of the wire W in the forward direction denoted with the arrow F.

When the wire W is fed in the forward direction denoted with the arrow F, a portion where the feeding path W1 of the wire W bends along the feeding gear 30*a* is on a downstream side of the meshing portion P1 of the feeding gear 30*a* and the feeding gear 30*b*. Thereby, when the wire W is fed in the forward direction denoted with the arrow F, a force in a direction away from the feeding gear 30*a* is applied to the wire W on the downstream side of the meshing portion P1 of the feeding gear 30*a* and the feeding gear 30*b*. The feeding path W1 of the wire W when the wire W is fed in the forward direction denoted with the arrow F is shown by a broken line in FIG. 2B. When the wire W is displaced in the direction away from the feeding gear 30*a*, the wire W comes into contact with the first guide surface 38*a* of the wire guide 38, so that an amount of displacement of the wire W in the direction away from the feeding gear 30*a* is controlled.

On the other hand, when the wire W is fed in the reverse direction denoted with the arrow R, the portion where the feeding path W1 of the wire W bends along the feeding gear 30*a* is on an upstream side of the meshing portion P1 of the feeding gear 30*a* and the feeding gear 30*b*. Thereby, when the wire W is fed in the reverse direction denoted with the arrow R, a force in a direction toward the feeding gear 30*a* is applied to the wire W on the upstream side of the meshing portion P1 of the feeding gear 30*a* and the feeding gear 30*b*. The feeding path W1 of the wire W when the wire W is fed in the reverse direction denoted with the arrow R is shown by a dashed-two dotted line in FIG. 2B. In the operation of feeding the wire W in the reverse direction denoted with the arrow R, when a force is applied in the direction in which the wire W comes close to the feeding gear 30*a*, the wire W is displaced until it comes into contact with the second guide surface 38*b* of the wire guide 38. Thereby, an amount of contact between the feeding gear 30*a* and the wire W is switched according to the direction in which the wire W is fed.

Figure 3A:
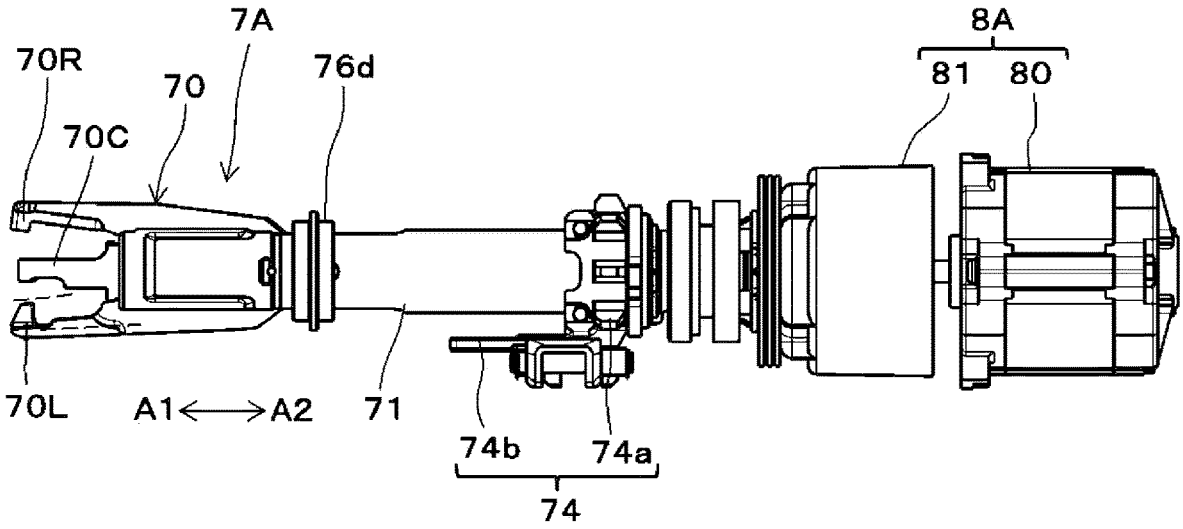
FIG. 3A is a top view showing an example of a binding unit and a drive unit.
Figure 3B:
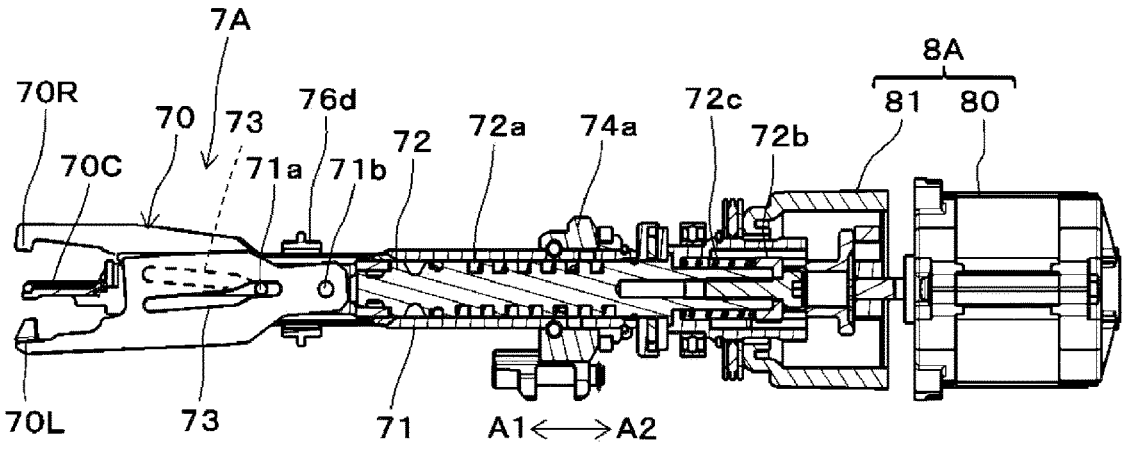
FIG. 3B is a top cross-sectional view showing the example of the binding unit and the drive unit.

FIG. 3A is a top view showing an example of the binding unit and the drive unit, and FIG. 3B is a top cross-sectional view showing the example of the binding unit and the drive unit. Subsequently, details of the binding unit 7A and a connection structure between the binding unit 7A and the drive unit 8A are described with reference to the respective drawings.

The binding unit 7A includes the wire engaging body 70 to which the wire W is engaged, and a rotary shaft 72 for actuating the wire engaging body 70. The binding unit 7A and the drive unit 8A are configured such that the rotary shaft 72 and the motor 80 are connected via the decelerator 81 and the rotary shaft 72 is driven via the decelerator 81 by the motor 80.

The wire engaging body 70 has a center hook 70C connected to the rotary shaft 72, a first side hook 70L and a second side hook 70R configured to open and close with respect to the center hook 70C, and a sleeve 71 configured to actuate the first side hook 70L and the second side hook 70R and to form the wire W into a desired shape.

In the binding unit 7A, a side on which the center hook 70C, the first side hook 70L and the second side hook 70R are provided is referred to as a front side, and a side on which the rotary shaft 72 is connected to the decelerator 81 is referred to as a rear side.

The center hook 70C is connected to a front end of the rotary shaft 72, which is one end portion, via a configuration that can rotate with respect to the rotary shaft 72 and move integrally with the rotary shaft 72 in an axis direction.

A tip end-side of the first side hook 70L, which is one end portion along the axis direction of the rotary shaft 72, is located on one side part with respect to the center hook 70C. In addition, a rear end-side of the first side hook 70L, which is the other end portion along the axis direction of the rotary shaft 72, is rotatably supported to the center hook 70C by a shaft 71*b*.

A tip end-side of the second side hook 70R, which is one end portion along the axis direction of the rotary shaft 72, is located on one the other side part with respect to the center hook 70C. In addition, a rear end-side of the second side hook 70R, which is the other end portion along the axis direction of the rotary shaft 72, is rotatably supported to the center hook 70C by the shaft 71*b*.

Thereby, in a rotating operation about the shaft 71*b* as a fulcrum, the wire engaging body 70 is configured to open/close in directions in which the tip end-side of the first side hook 70L contacts and separates from the center hook 70C. In addition, the wire engaging body 70 is also configured to open/close in directions in which the tip end-side of the second side hook 70R contacts and separates from the center hook 70C.

The sleeve 71 has a convex portion (not shown) protruding to an inner peripheral surface of a space in which the rotary shaft 72 is inserted, and the convex portion enters a groove portion of a feeding screw 72*a* formed along the axis direction on an outer periphery of the rotary shaft 72. When the rotary shaft 72 rotates, the sleeve 71 moves in the front and rear direction along the axis direction of the rotary shaft 72 according to a rotation direction of the rotary shaft 72 by an action of the convex portion (not shown) and the feeding screw 72*a* of the rotary shaft 72. The sleeve 71 is also configured to rotate integrally with the rotary shaft 72.

The sleeve 71 has an opening/closing pin 71*a* for opening/closing the first side hook 70L and the second side hook 70R.

The opening/closing pin 71*a* is inserted into opening/closing guide holes 73 formed in the first side hook 70L and the second side hook 70R. The opening/closing guide hole 73 has a shape of extending along a moving direction of the sleeve 71 and converting a linear motion of the opening/closing pin 71*a* configured to move in conjunction with the sleeve 71 into an opening/closing operation by rotation of the first side hook 70L and the second side hook 70R about the shaft 71*b* as a fulcrum.

The wire engaging body 70 is configured such that, when the sleeve 71 is moved in a rearward direction denoted with an arrow A2, the first side hook 70L and the second side hook 70R move away from the center hook 70C by the rotating operation about the shaft 71*b* as a fulcrum, due to a locus of the opening/closing pin 71*a* and the shape of the opening/closing guide holes 73.

Thereby, the first side hook 70L and the second side hook 70R are opened with respect to the center hook 70C, so that a feeding path through which the wire W is to pass is formed between the first side hook 70L and the center hook 70C and between the second side hook 70R and the center hook 70C.

In a state where the first side hook 70L and the second side hook 70R are opened with respect to the center hook 70C, the wire W that is fed by the wire feeding unit 3A passes between the center hook 70C and the first side hook 70L. The wire W passing between the center hook 70C and the first side hook 70L is guided to the curl forming unit 5A. Then, the wire W curled by the curl forming unit 5A and guided to the binding unit 7A passes between the center hook 70C and the second side hook 70R.

The wire engaging body 70 is configured such that, when the sleeve 71 is moved in a forward direction denoted with an arrow A1, the first side hook 70L and the second side hook 70R move toward the center hook 70C by the rotating operation about the shaft 71*b* as a fulcrum, due to the locus of the opening/closing pin 71*a* and the shape of the opening/closing guide holes 73. Thereby, the first side hook 70L and the second side hook 70R are closed with respect to the center hook 70C.

When the first side hook 70L is closed with respect to the center hook 70C, the wire W sandwiched between the first side hook 70L and the center hook 70C is engaged in such an aspect that the wire can move between the first side hook 70L and the center hook 70C. Also, when the second side hook 70R is closed with respect to the center hook 70C, the wire W sandwiched between the second side hook 70R and the center hook 70C is engaged in such an aspect that the wire cannot come off between the second side hook 70R and the center hook 70C.

As shown in FIG. 1A, the sleeve 71 has a bending portion 71*c*1 configured to push and bend a tip end-side (one end portion) of the wire W in a predetermined direction to form the wire W into a predetermined shape, and a bending portion 71*c*2 configured to push and bend a terminal end-side (the other end portion) of the wire W cut by the cutting unit 6A in a predetermined direction to form the wire W into a predetermined shape.

The sleeve 71 is moved in the forward direction denoted with the arrow A1, so that the tip end-side of the wire W engaged by the center hook 70C and the second side hook 70R is pushed and bent toward the reinforcing bars S by the bending portion 71*c*1. Also, the sleeve 71 is moved in the forward direction denoted with the arrow A1, so that the terminal end-side of the wire W engaged by the center hook 70C and the first side hook 70L and cut by the cutting unit 6A is pushed and bent toward the reinforcing bars S by the bending portion 71*c*2.

The binding unit 7A includes a rotation regulation part 74 configured to regulate rotations of the wire engaging body 70 and the sleeve 71 interlocking with the rotating operation of the rotary shaft 72. The rotation regulation part 74 has a rotation regulation blade 74*a* provided to the sleeve 71 and a rotation regulation claw 74*b* provided to the main body part 10A.

The rotation regulation blade 74*a* is constituted by a plurality of convex portions protruding radially from an outer periphery of the sleeve 71 and provided with predetermined intervals in a circumferential direction of the sleeve 71. The rotation regulation blade 74*a* is fixed to the sleeve 71 and is moved and rotated integrally with the sleeve 71.

In an operation area where the wire W is engaged by the wire engaging body 70, the wire W is wound on the reinforcing bars S and is then cut and the wire W is bent and formed by the bending portions 71*c*1 and 71*c*2 of the sleeve 71, the rotation regulation blade 74*a* of the rotation regulation part 74 is engaged to the rotation regulation claw 74*b*. When the rotation regulation blade 74*a* is engaged to the rotation regulation claw 74*b*, the rotation of the sleeve 71 in conjunction with the rotation of the rotary shaft 72 is regulated, so that the sleeve 71 is moved in the front and rear direction by the rotating operation of the rotary shaft 72.

In addition, in an operation area where the wire W engaged by the wire engaging body 70 is twisted, the rotation regulation blade 74*a* of the rotation regulation part 74 is disengaged from the rotation regulation claw 74*b*. When the rotation regulation blade 74*a* is disengaged from the rotation regulation claw 74*b*, the sleeve 71 is rotated in conjunction with the rotation of the rotary shaft 72. The center hook 70C, the first side hook 70L and the second side hook 70R of the wire engaging body 70 engaging the wire W are rotated in conjunction with the rotation of the sleeve 71.

In the binding unit 7A, the movable member 83 is provided to be movable in conjunction with the sleeve 71. The movable member 83 is rotatably attached to the sleeve 71, does not operate in conjunction with the rotation of the sleeve 71, and is configured to move in the front and rear direction in conjunction with the sleeve 71.

In the binding unit 7A, when the movable member 83 moves in the front and rear direction in conjunction with the sleeve 71, the movable member 83 and the transmission mechanism 62 are engaged with each other and the movable blade part (not shown) of the cutting unit 6A is actuated. Thereby, in the forward moving operation of the sleeve 71, the wire W is cut by the cutting unit 6A.

The rotary shaft 72 is connected at a rear end, which is the other end portion, to the decelerator 81 via a connection portion 72*b* having a configuration of enabling the rotary shaft 72 to rotate integrally with the decelerator 81 and to move in the axis direction with respect to the decelerator 81. The connection portion 72*b* has a spring 72*c* for urging the rotary shaft 72 in the rearward direction toward the decelerator 81. Thereby, the rotary shaft 72 is configured to be movable in the forward direction away from the decelerator 81 while receiving a force pushed rearward by the spring 72*c*. Therefore, when a force for moving forward the wire engaging body 70 along the axis direction is applied, the rotary shaft 72 can move forward while receiving the force pushed rearward by the spring 72*c*.

Operation Example of Reinforcing Bar Binding Machine of Present Embodiment

Figure 4A:
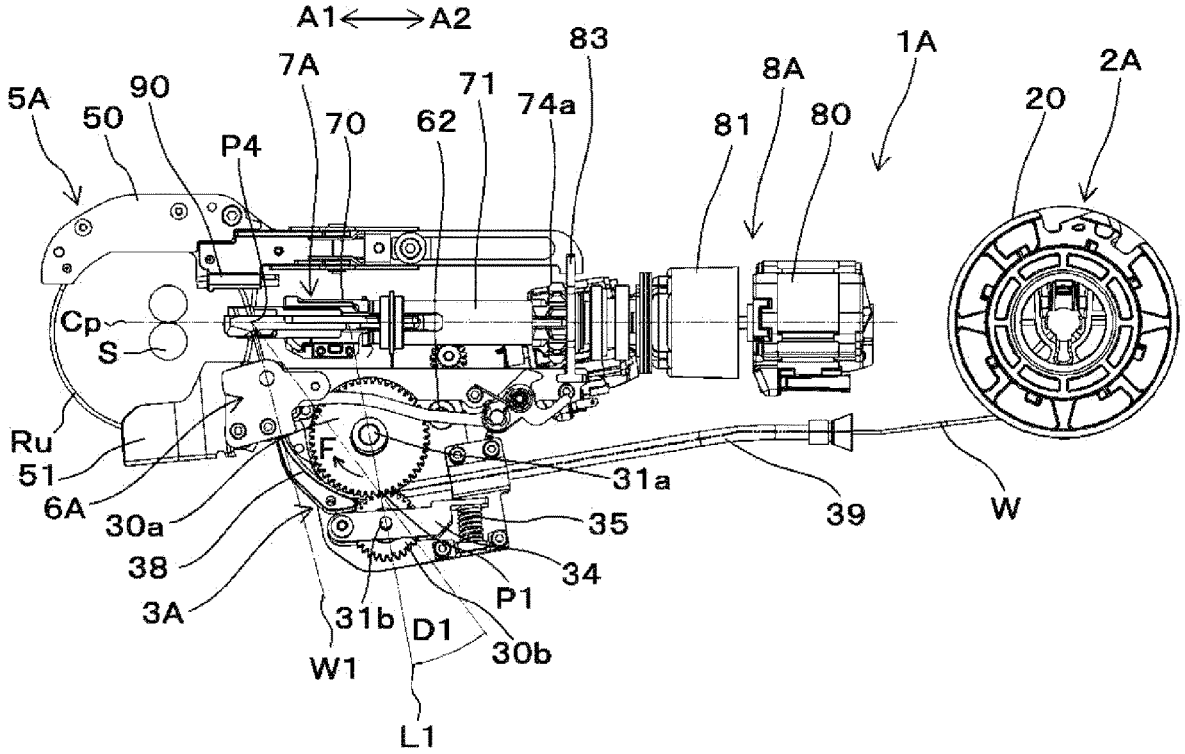
FIG. 4A is a side view of main parts of the reinforcing bar binding machine of the present embodiment.
Figure 4B:
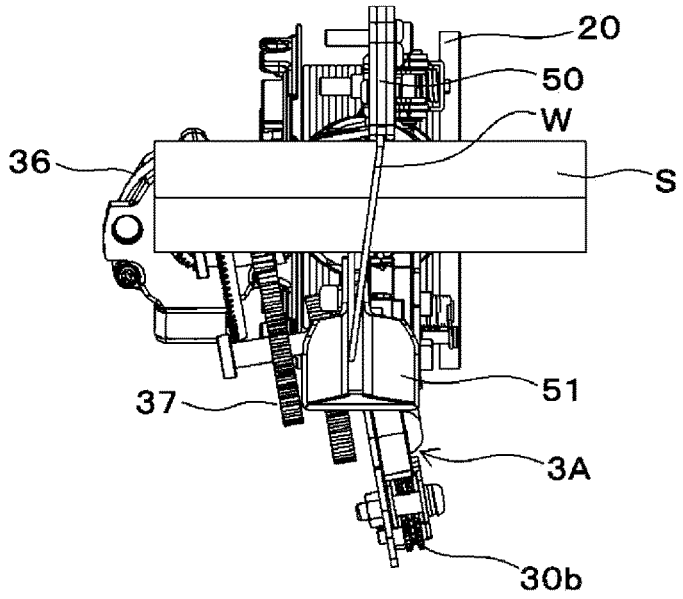
FIG. 4B is a front view of main parts of the reinforcing bar binding machine of the present embodiment.

FIG. 4A is a side view of main parts of the reinforcing bar binding machine of the present embodiment, and FIG. 4B is a front view of main parts of the reinforcing bar binding machine of the present embodiment, showing an operation during feeding of the wire.

Figure 5A:
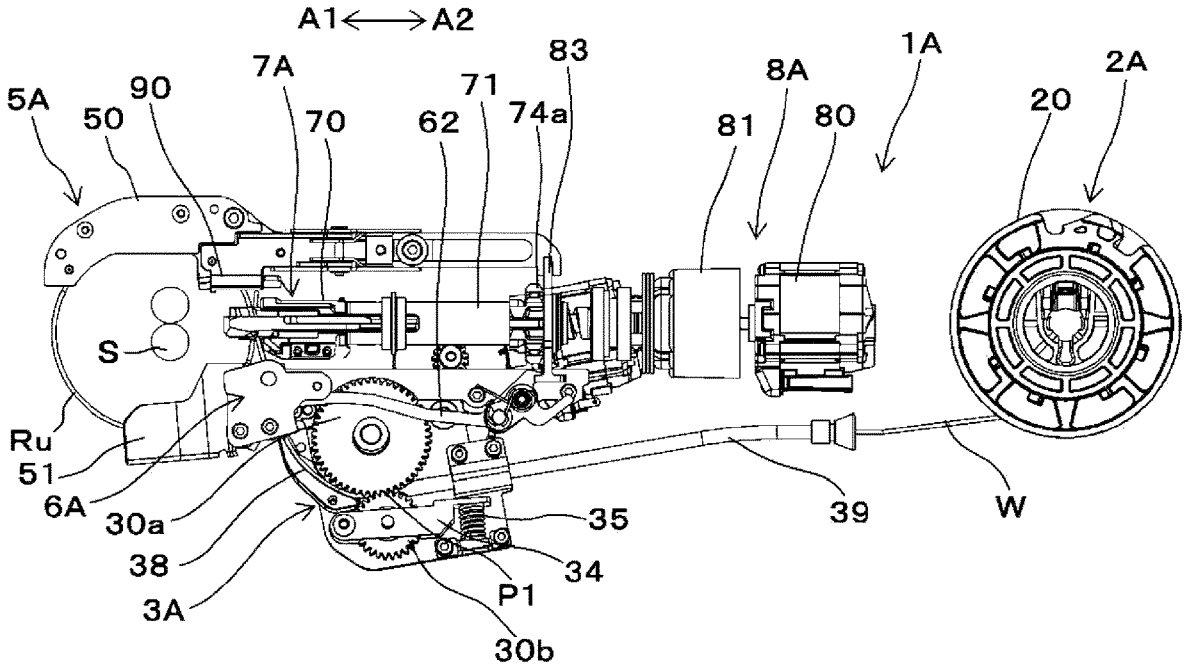
FIG. 5A is a side view of main parts of the reinforcing bar binding machine of the present embodiment.
Figure 5B:
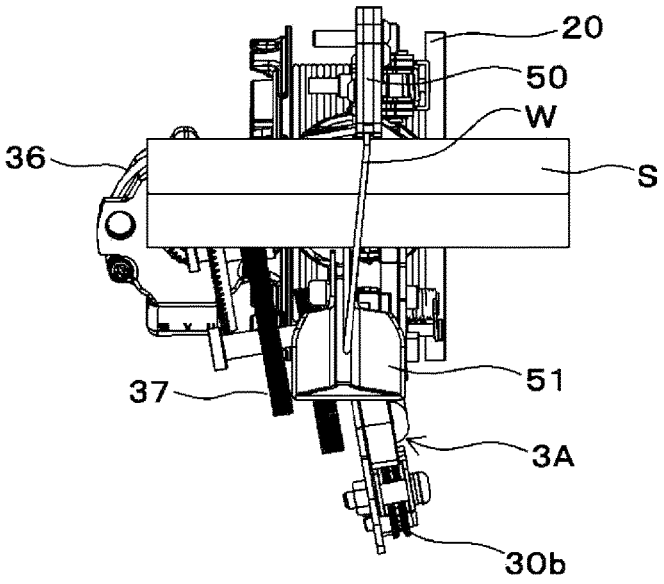
FIG. 5B is a front view of main parts of the reinforcing bar binding machine of the present embodiment.

FIG. 5A is a side view of main parts of the reinforcing bar binding machine of the present embodiment, and FIG. 5B is a front view of main parts of the reinforcing bar binding machine of the present embodiment, showing an operation during engaging of the wire.

FIGS. 6A, 7A, 8A and 9A are side views of main parts of the reinforcing bar binding machine of the present embodiment, and FIGS. 6B, 7B, 8B and 9B are front views of main parts of the reinforcing bar binding machine of the present embodiment, showing operations during reverse feeding of the wire.

Subsequently, the operation of binding the reinforcing bars S with the wire W by the reinforcing bar binding machine 1A of the first embodiment is described with reference to the respective drawings.

When the reinforcing bars S are inserted between the curl guide 50 and the induction guide 51 of the curl forming unit 5A and the trigger 12A is operated, the feeding motor 36 is driven in the forward rotation direction, so that the wire W is fed in the forward direction denoted with the arrow F by the wire feeding unit 3A, as shown in FIG. 4A.

The wire W pulled out from the reel 20 accommodated in the magazine 2A is guided to the wire feeding unit 3A in the direction along the front and rear direction by the guide member 39, and is sandwiched at the meshing portion P1 of the feeding gear 30*a* and the feeding gear 30*b* between the feeding gear 30*a* and the feeding gear 30*b*. The wire W sandwiched between the feeding gear 30*a* and the feeding gear 30*b* is bent on the feeding path W1 by the wire guide 38 on the downstream side of the meshing portion P1 of the feeding gear 30*a* and the feeding gear 30*b* with respect to the feeding direction of the wire W in the forward direction denoted with the arrow F, and is guided to the cutting unit 6A, between the center hook 70C and the first side hook 70L of the binding unit 7A and to the curl guide 50 of the curl forming unit 5A.

Here, when the wire W is fed in the forward direction denoted with the arrow F, as a value for prescribing a position of the wire feeding unit 3A, for example, an angle D1 between the straight line L1 connecting the shaft 31*a* of the feeding gear 30*a* and the shaft 31*b* of the feeding gear 30*b* and a straight line passing an intersection P4 of the meshing portion P1 of the feeding gear 30*a* and the feeding gear 30*b*, a rotation center Cp of the wire engaging body 70, and the feeding path W1 of the wire W is 80 degrees or less.

The wire W that is fed in the forward direction pass between the center hook 70C and the first side hook 70L, and is fed to the curl guide 50 of the curl forming unit 5A. The wire W passes through the curl guide 50 and is thus curled to be wound around the reinforcing bars S.

The wire W curled by the curl guide 50 is guided to the induction guide 51 and is further fed in the forward direction by the wire feeding unit 3A, so that the wire is guided between the center hook 70C and the second side hook 70R by the induction guide 51. Then, the wire W is fed until the tip end is butted against the feeding regulation part 90. When the wire W is fed to a position where the tip end thereof is butted against the feeding regulation part 90, the drive of the feeding motor 36 is stopped.

After stopping the feeding of the wire W in the forward direction, the motor 80 is driven in the forward rotation direction. In a first operation area where the wire W is engaged by the wire engaging body 70, the rotation regulation blade 74*a* is engaged to the rotation regulation claw 74*b*, so that the rotation of the sleeve 71 in conjunction with the rotation of the rotary shaft 72 is regulated. Thereby, as shown in FIG. 5A, the rotation of the motor 80 is converted into linear movement, so that the sleeve 71 is moved in the forward direction denoted with the arrow A1.

When the sleeve 71 is moved in the forward direction, the opening/closing pin 71*a* passes through the opening/closing guide holes 73. Thereby, the first side hook 70L is moved toward the center hook 70C by the rotating operation about the shaft 71*b* as a fulcrum. When the first side hook 70L is closed with respect to the center hook 70C, the wire W sandwiched between the first side hook 70L and the center hook 70C is engaged in such an aspect that the wire can move between the first side hook 70L and the center hook 70C.

In addition, the second side hook 70R is moved toward the center hook 70C by the rotating operation about the shaft 71*b* as a fulcrum. When the second side hook 70R is closed with respect to the center hook 70C, the wire W sandwiched between the second side hook 70R and the center hook 70C is engaged in such an aspect that the wire cannot come off between the second side hook 70R and the center hook 70C.

After the sleeve 71 is advanced to a position where the wire W is engaged by the closing operation of the first side hook 70L and the second side hook 70R, the rotation of the motor 80 is temporarily stopped and the feeding motor 36 is driven in the reverse rotation direction.

Figure 6A:
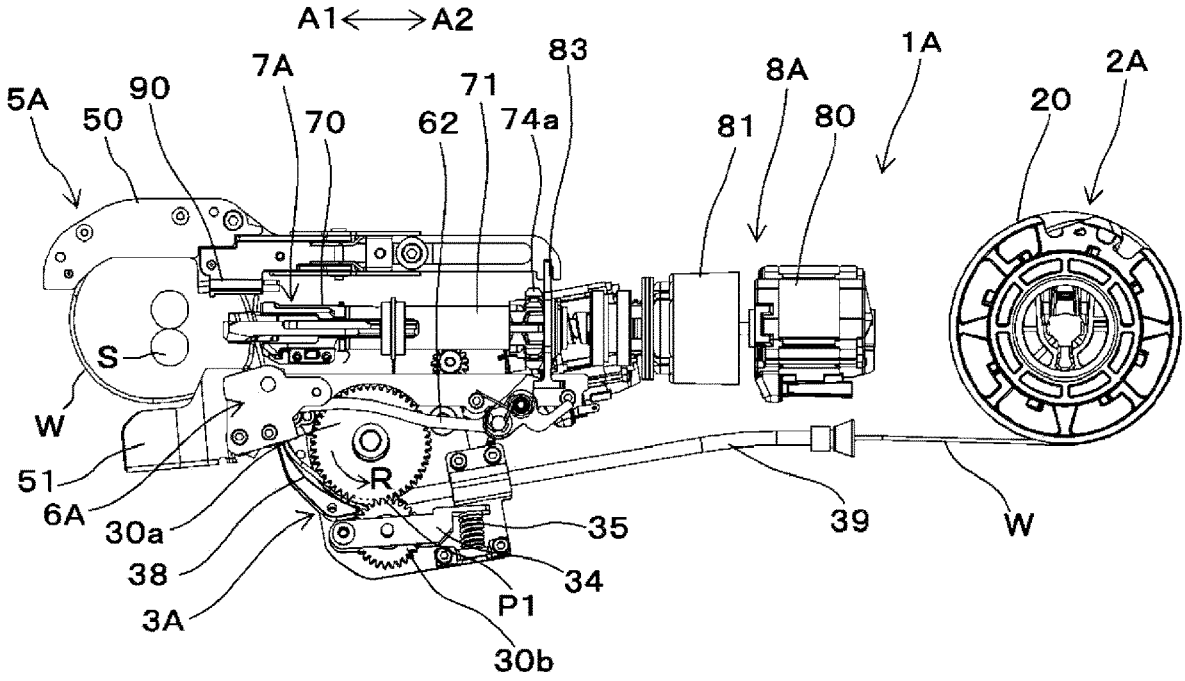
FIG. 6A is a side view of main parts of the reinforcing bar binding machine of the present embodiment.
Figure 6B:
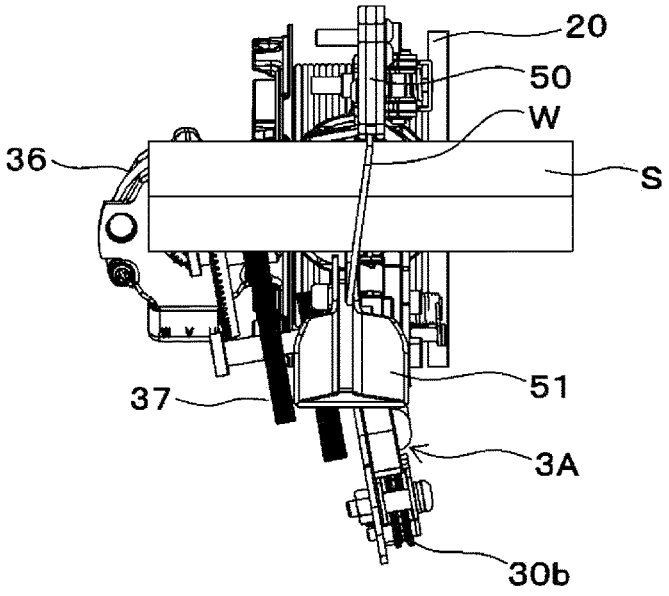
FIG. 6B is a front view of main parts of the reinforcing bar binding machine of the present embodiment.

When the feeding motor 36 is driven in the reverse rotation direction, the feeding gear 30*a* is reversely rotated, and accordingly, the feeding gear 30*b* is driven to reversely rotate. Thereby, the wire W sandwiched between the feeding gear 30*a* and the feeding gear 30*b* is fed in the reverse direction denoted with the arrow R. Since the wire W wound around the reinforcing bars S is engaged in such an aspect that the tip end-side thereof cannot come off between the second side hook 70R and the center hook 70C, the wire W is displaced in a direction from the induction guide 51-side toward the reinforcing bars S by the operation of feeding the wire W in the reverse direction, as shown in FIGS. 6A and 6B.

Figure 7A:
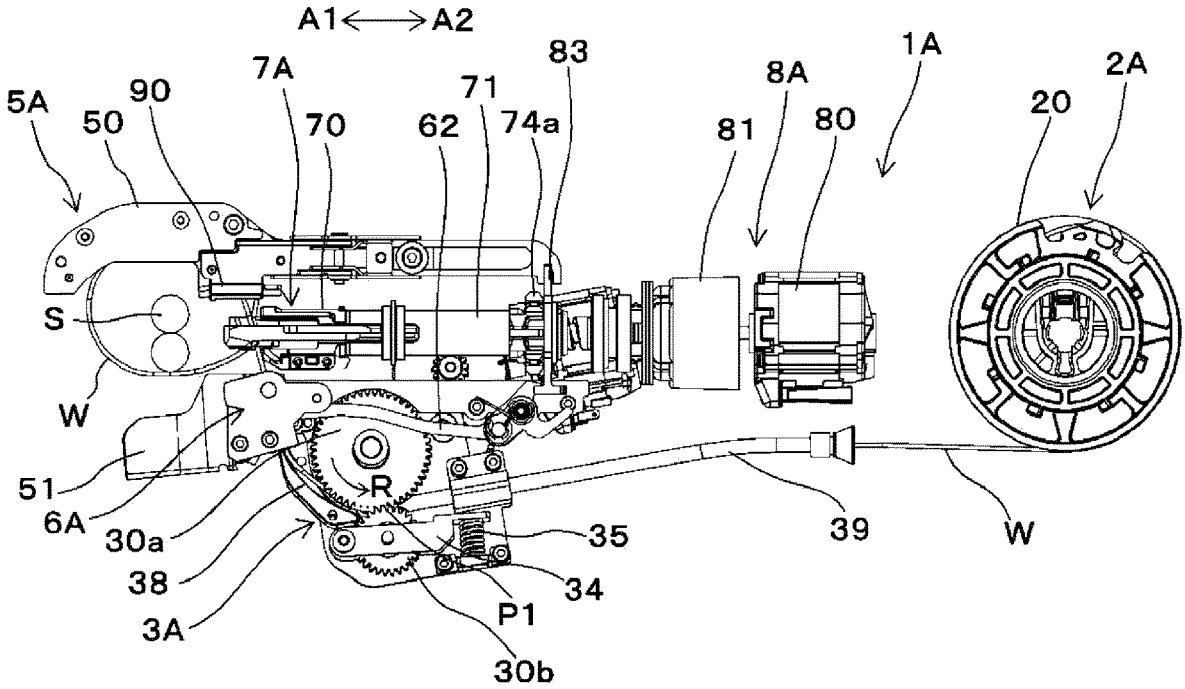
FIG. 7A is a side view of main parts of the reinforcing bar binding machine of the present embodiment.
Figure 7B:
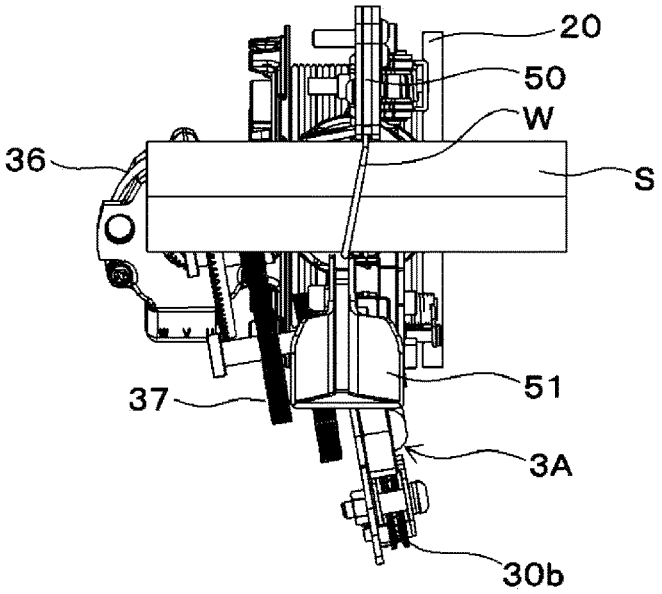
FIG. 7B is a front view of main parts of the reinforcing bar binding machine of the present embodiment.
Figure 8A:
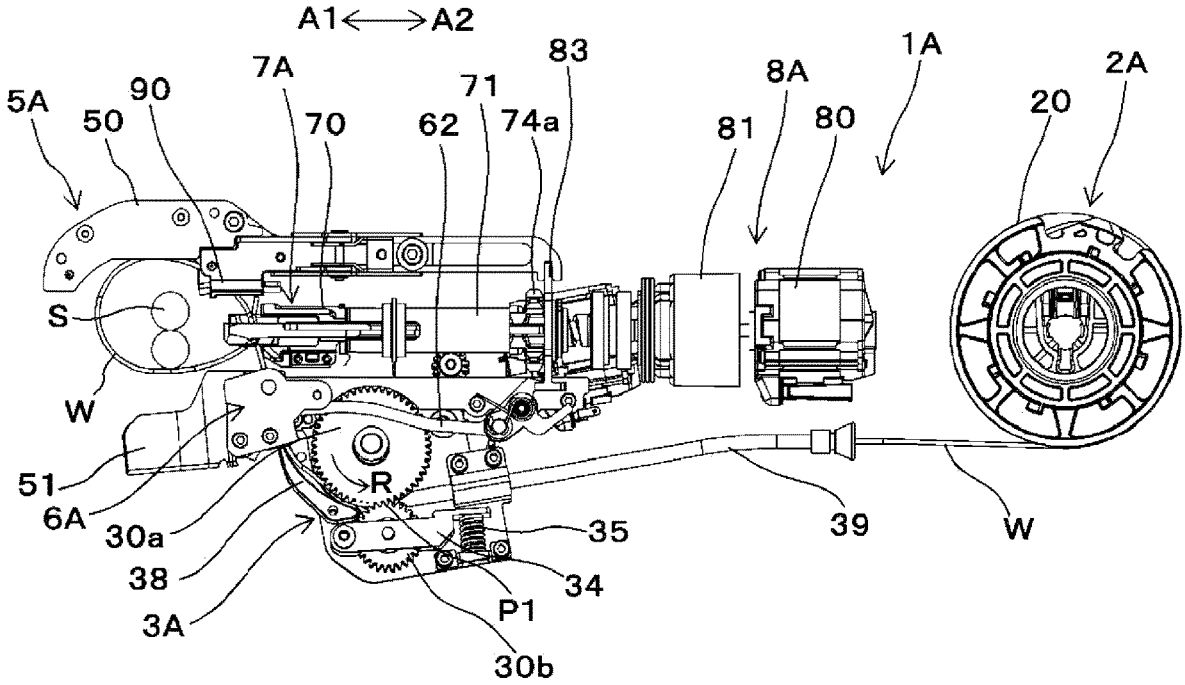
FIG. 8A is a side view of main parts of the reinforcing bar binding machine of the present embodiment.
Figure 8B:
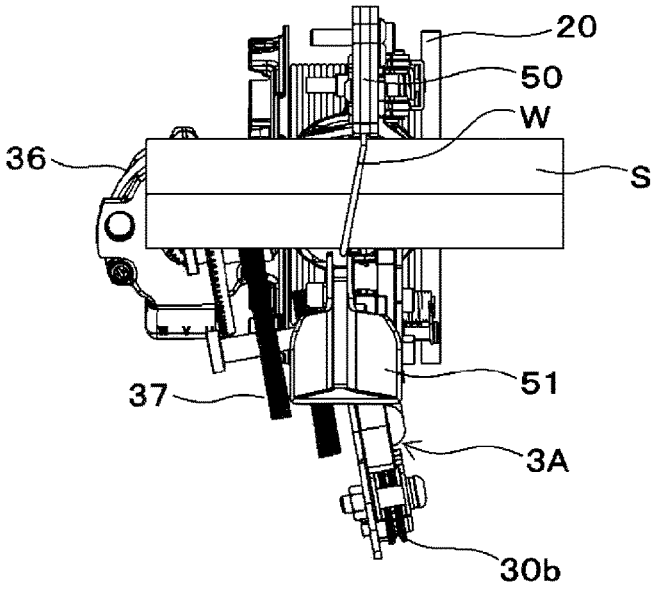
FIG. 8B is a front view of main parts of the reinforcing bar binding machine of the present embodiment.
Figure 9A:
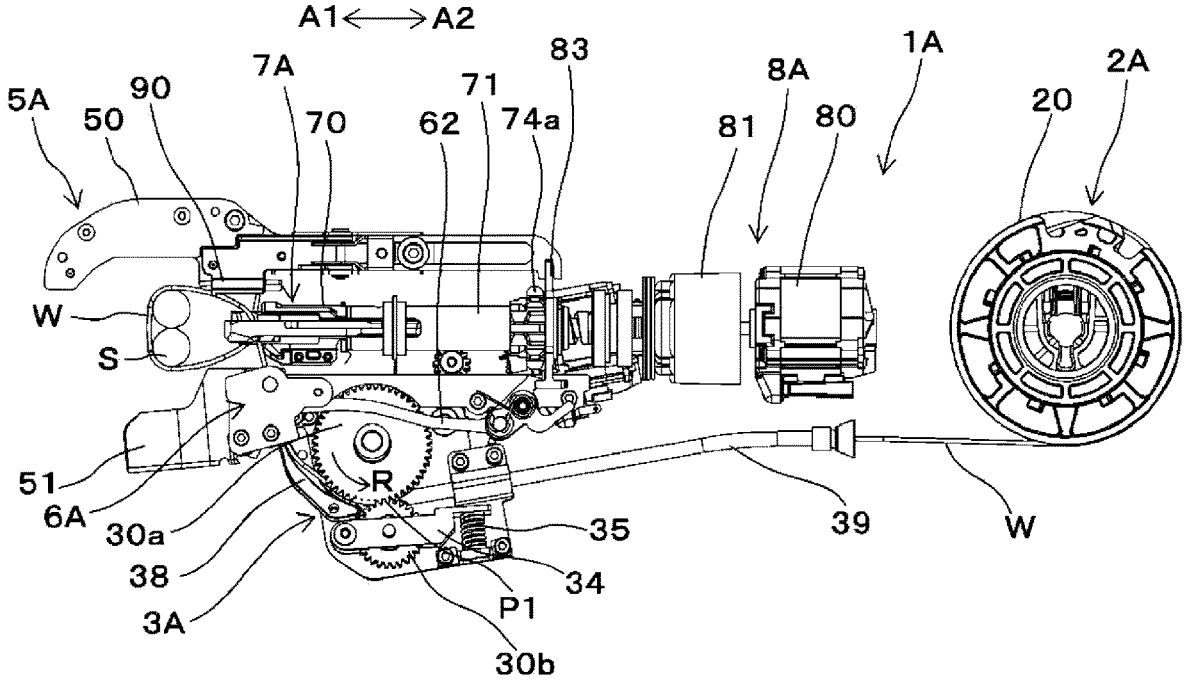
FIG. 9A is a side view of main parts of the reinforcing bar binding machine of the present embodiment.
Figure 9B:
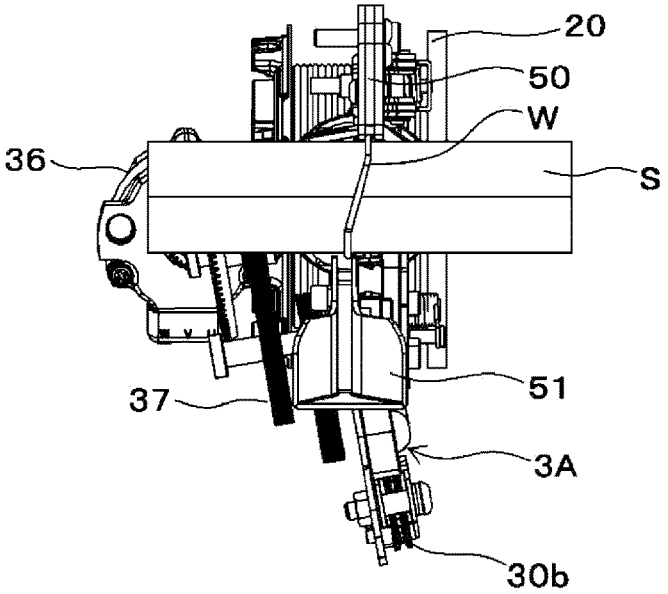
FIG. 9B is a front view of main parts of the reinforcing bar binding machine of the present embodiment.

When the wire W displaced from the induction guide 51-side toward the reinforcing bars S comes into contact with the reinforcing bars S, as shown in FIGS. 7A and 7B, the wire W on the curl guide 50-side is displaced toward the reinforcing bars S, as shown in FIGS. 8A and 8B. Then, in the operation of further feeding the wire W in the reverse direction, the wire W displaced from the curl guide 50-side toward the reinforcing bars S comes into contact with the reinforcing bars S, as shown in FIGS. 9A and 9B.

Figure 10A:
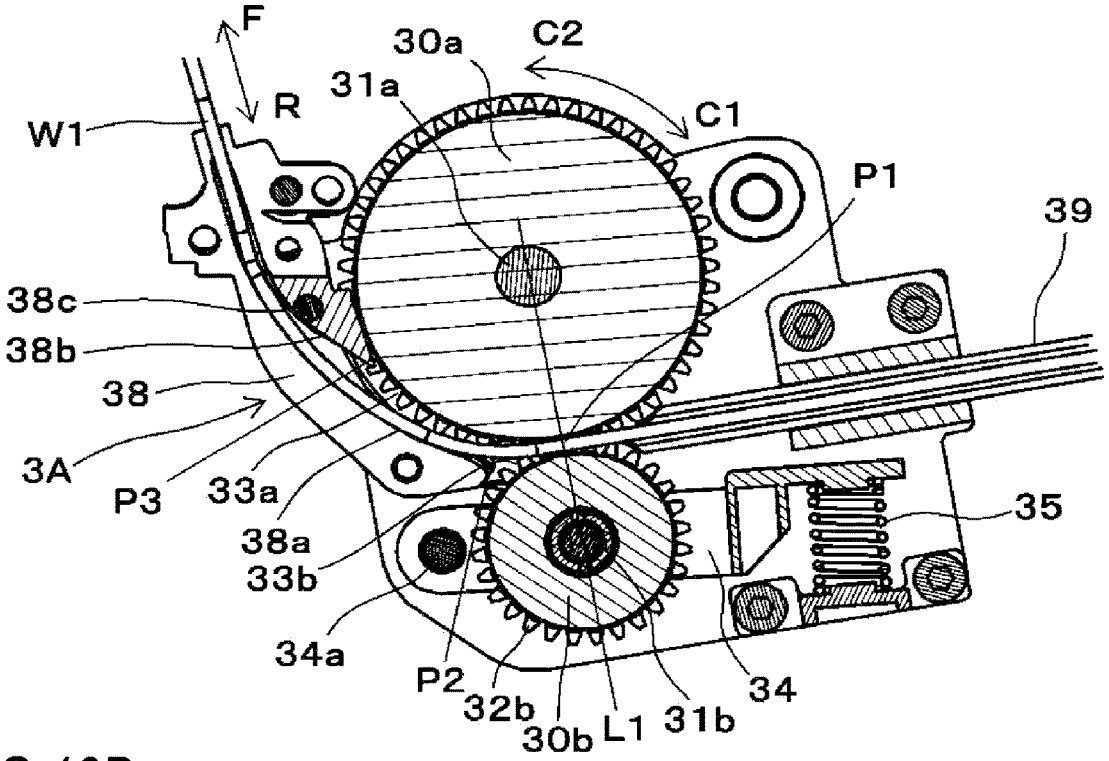
FIG. 10A is a side cross-sectional view of the wire feeding unit showing an example of an operation when feeding a wire in a forward direction.
Figure 10B:
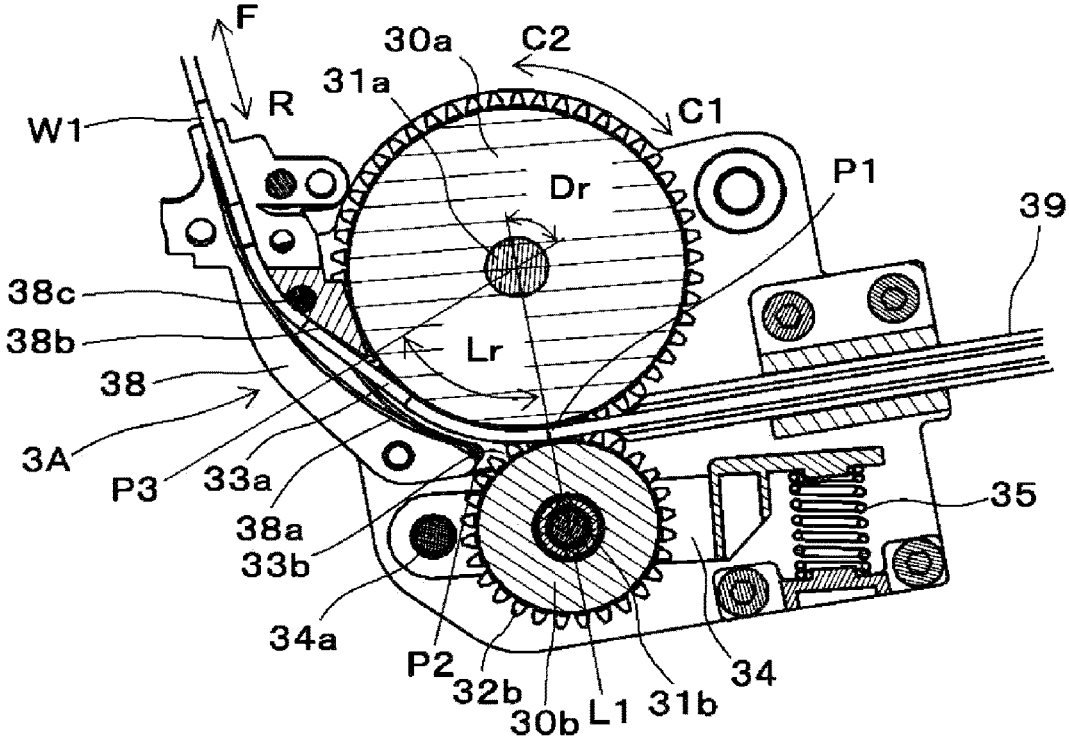
FIG. 10B is a side cross-sectional view of the wire feeding unit showing an example of an operation when feeding the wire in a reverse direction.

FIG. 10A is a side cross-sectional view of the wire feeding unit showing an example of an operation when feeding the wire in the forward direction, and FIG. 10B is a side cross-sectional view of the wire feeding unit showing an example of an operation when feeding the wire in the reverse direction.

When the wire W is fed in the forward direction denoted with the arrow F, a portion where the feeding path W1 of the wire W bends along the feeding gear 30*a* is on a downstream side of the meshing portion P1 of the feeding gear 30*a* and the feeding gear 30*b*. Thereby, as shown in FIG. 10A, when the wire W is fed in the forward direction denoted with the arrow F, a force in the direction away from the feeding gear 30*a* is applied to the wire W. When the wire W is displaced in the direction away from the feeding gear 30*a* up to a position where the wire W comes into contact with the first guide surface 38*a* of the wire guide 38, a portion where the wire W and the feeding gear 30*a* come into contact is the meshing portion P1 of the feeding gear 30*a* and the feeding gear 30*b*.

On the other hand, when the wire W is fed in the reverse direction denoted with the arrow R, the portion where the feeding path W1 of the wire W bends along the feeding gear 30*a* is on an upstream side of the meshing portion P1 of the feeding gear 30*a* and the feeding gear 30*b*. Thereby, as shown in FIG. 10B, when the wire W is fed in the reverse direction denoted with the arrow R, a force in the direction toward the feeding gear 30*a* is applied to the wire W whose feeding path W1 is bent along the feeding gear 30*a*.

In the operation of feeding the wire W in the reverse direction denoted with the arrow R, when a force is applied in the direction in which the wire W comes close to the feeding gear 30*a*, the wire W is displaced until it comes into contact with the second guide surface 38*b* of the wire guide 38.

When the wire W is displaced until the wire W comes into contact with the second guide surface 38*b* of the wire guide 38, in the operation of feeding the wire W in the reverse direction denoted with the arrow R, a portion where the wire W and the feeding gear 30*a* come into contact with each other is a range from the meshing portion P1 of the feeding gear 30*a* and the feeding gear 30*b* to the start point portion P3 of the second guide surface 38*b* of the wire guide 38.

The portion where the wire W and the feeding gear 30*a* come into contact with each other is the meshing portion P1 of the feeding gear 30*a* and the feeding gear 30*b* in the operation of feeding the wire W in the forward direction denoted with the arrow F. On the other hand, in the operation of feeding the wire W in the reverse direction denoted with the arrow R, the portion where the wire W and the feeding gear 30*a* come into contact with each other is a range from the meshing portion P1 of the feeding gear 30*a* and the feeding gear 30*b* to the start point portion P3 of the second guide surface 38*b* of the wire guide 38, so that an amount of contact between the wire W and the feeding gear 30*a* increases, as compared to the case where the wire W is fed in the forward direction denoted with the arrow F. Note that, in the operation of feeding the wire W in the reverse direction denoted with the arrow R, the portion where the wire W and the feeding gear 30*a* come into contact with each other may not be the entire range from the meshing portion P1 to the start point portion P3, as long as the amount of contact between the wire W and the feeding gear 30*a* increases, as compared to the case where the wire W is fed in the forward direction denoted with the arrow F.

Thereby, an amount of contact Lr (contact angle Dr) between the wire W and the feeding gear 30*a* is larger when the wire W is fed in the reverse direction denoted with the arrow R, as compared to the case where the wire W is fed in the forward direction denoted with the arrow F. Therefore, the load applied from the feeding gear 30*a* to the wire W increases and the tension applied to the wire W increases when the wire W is fed in the reverse direction denoted with the arrow R, as compared to the case where the wire W is fed in the forward direction denoted with the arrow F.

Therefore, the wire W that is displaced in the direction from the induction guide 51-side toward the reinforcing bars S and the wire W that is displaced in the direction from the curl guide 50-side toward the reinforcing bars S are wound so as to be in close contact with the reinforcing bars S.

Further, when feeding the wire W in the reverse direction denoted with the arrow R without unnecessarily increasing the pressing force of the spring 35 that presses the wire W against the feeding gear 30*a* via the feeding gear 30*b*, the load that is applied from the feeding gear 30*a* to the wire W can be increased. Therefore, when feeding the wire W in the forward direction denoted with the arrow F, the load applied from the feeding gear 30*a* to the wire W does not increase beyond necessity, and the decrease in feeding speed of the wire W can be suppressed. In addition, it is possible to suppress occurrence of buckling of the wire W, which is caused when the force of feeding the wire W in the forward direction becomes strong.

Note that, the feeding gear 30*a* has the groove portion 33*a* formed on the gear portion 32*a* along the circumferential direction, and the wire W enters the groove portion 33*a*. Thereby, the portion of the groove portion 33*a* where the wire W comes into contact is not a continuous surface in the circumferential direction, but a discontinuous surface corresponding to presence or absence of the tooth portion of the gear portion 32*a*. Therefore, the feeding gear 30*a* is made to have a diameter larger than the feeding gear 30*b*, so that the number of teeth of the gear portion 32*a* of the feeding gear 30*a* can be made larger than that of the gear portion 32*b* of the feeding gear 30*b*. Therefore, a contact surface between the feeding gear 30*a* and the wire W can be increased, so that the load applied from the feeding gear 30*a* to the wire W can be increased.

Further, in the operation of feeding the wire W in the reverse direction denoted with the arrow R, the wire W is displaced until it comes into contact with the second guide surface 38*b* of the wire guide 38, and then the wire W is fed in the forward direction in the next binding operation. In this case, the second guide surface 38*b* is provided at a position where the start point portion P3 enters the groove portion 33*a* of the feeding gear 30*a*, so that the wire W is suppressed from fitting in the groove portion 33*a* and being fed wound on the feeding gear 30*a* and can be guided to the predetermined feeding path W1.

Further, in a configuration of feeding two or more wires W, a plurality of a pair of feeding gear 30*a* and feeding gear 30*b* may be provided along the axis direction, according to the number of wires W. Alternatively, the groove portions 33*a* may be provided at a plurality of locations along the axis direction on the outer peripheral surface of the feeding gear 30*a*, and the groove portions 33*b* may be provided at a plurality of locations along the axis direction on the outer peripheral surface of the feeding gear 30*b*. Further, the groove portion 33*a* having such a shape that a plurality of wires W are aligned along the axis direction may be provided on the outer peripheral surface of the feeding gear 30*a*, and the groove portion 33*b* having such a shape that a plurality of wires W are aligned along the axis direction may be provided on the outer peripheral surface of the feeding gear 30*b*. Note that, the wire feeding unit 3A is not limited to the pair of feeding gears having gear portions formed on the outer peripheries, and may also be a pair of feeding rollers arranged so that outer peripheries face each other.

After the wire W is wound on the reinforcing bars S and the drive of the feeding motor 36 in the reverse rotation direction is stopped, the motor 80 is driven in the forward rotation direction, so that the sleeve 71 is moved in the forward direction denoted with the arrow A1. The movement of the sleeve 71 in the forward direction is transmitted to the cutting unit 6A by the transmission mechanism 62, so that the movable blade part (not shown) is actuated to cut the wire W engaged by the first side hook 70L and the center hook 70C.

When the wire W is cut, the tip end-side of the wire W engaged by the center hook 70C and the second side hook 70R is pressed and bent toward the reinforcing bars S by the bending portion 71*c*1. In addition, the terminal end-side of the wire W engaged by the center hook 70C and the first side hook 70L and cut by the cutting unit 6A is pressed and bent toward the reinforcing bars S by the bending portion 71*c*2.

After the tip end-side and the terminal end-side of the wire W are bent toward the reinforcing bars S, the motor 80 is further driven in the forward rotation direction, so that the sleeve 71 is further moved in the forward direction. The sleeve 71 is moved to a predetermined position and therefore reaches an operation area where the wire W engaged by the wire engaging body 70 is twisted, and the engaging of the rotation regulation blade 74*a* with the rotation regulation claw 74*b* is released.

Thereby, the motor 80 is further driven in the forward rotation direction, so that the sleeve 71 rotates in conjunction with the rotary shaft 72 and the wire W engaged by the wire engaging body 70 is twisted.

As the wire W engaged by the wire engaging body 70 is twisted, a force that pulls the wire engaging body 70 forward along the axis direction of the rotary shaft 72 is applied, so that the rotary shaft 72 receives a force pushed rearward by the spring 72*c*, and accordingly, the binding unit 7A twists the wire W while moving forward together with the wire engaging body 70.

Therefore, the wire W is further twisted while the wire engaging body 70 and the rotary shaft 72 move in the forward direction in which a gap between the twisted portion of the wire W and the reinforcing bars S becomes smaller.

Therefore, the wire W is brought into close contact with the reinforcing bars S along the reinforcing bars S, so that the reinforcing bars S can be bound in a state where the wire W is in close contact with the reinforcing bars S.

When it is detected that the load applied to the motor 80 is maximized as the wire W is twisted, the forward rotation of the motor 80 is stopped. Next, when the motor 80 is driven in the reverse rotation direction, the rotary shaft 72 reversely rotates and the sleeve 71 reversely rotates following the reverse rotation of the rotary shaft 72, the rotation regulation blade 74*a* is engaged with the rotation regulation claw 74*b*, so that the rotation of the sleeve 71 in conjunction with the rotation of the rotary shaft 72 is regulated. Thereby, the sleeve 71 moves in the direction of the arrow A2, which is a rearward direction.

When the sleeve 71 moves in the rearward direction, the bending portions 71*c*1 and 71*c*2 are separated from the wire W, and the holding of the wire W by the bending portions 71*c*1 and 71*c*2 is released. In addition, when the sleeve 71 moves in the rearward direction, the opening/closing pin 71*a* passes through the opening/closing guide holes 73. Thereby, the first side hook 70L is moved away from the center hook 70C by the rotating operation about the shaft 71*b* as a fulcrum. In addition, the second side hook 70R is moved away from the center hook 70C by the rotating operation about the shaft 71*b* as a fulcrum. Thereby, the wire W comes off from the wire engaging body 70.

Additional Notes

This application discloses at least the following inventions (1) to (12).

(1) A binding machine includes: a wire feeding unit configured to feed a wire; a curl forming unit configured to form a path along which the wire fed by the wire feeding unit is to be wound around a to-be-bound object; a cutting unit configured to cut the wire wound on the to-be-bound object; and a binding unit configured to twist the wire wound on the to-be-bound object and cut by the cutting unit. The wire feeding unit includes a feeding member having a part that is in contact with the wire and configured to feed the wire with being displaced along a feeding direction of the wire. An amount of contact between the feeding member and the wire is switched in accordance with the feeding direction of the wire. As compared to the amount of contact between the feeding member and the wire in an operation of feeding the wire in one direction and winding the wire around the to-be-bound object, the amount of contact between the feeding member and the wire in an operation of feeding the wire in other direction, which is opposite to the one direction, and winding the wire on the to-be-bound object is made larger.

In the present invention, a load that is applied from the feeding member to the wire in the operation of feeding the wire in the other direction, which is opposite to the one direction, and winding the wire on the to-be-bound object becomes larger than a load that is applied from the feeding member to the wire in the operation of feeding the wire in the one direction and winding the wire around the to-be-bound object. Therefore, it is possible to pull back the wire with a strong force without increasing the load that is applied from the feeding member to the wire when feeding the wire in the one direction.

In the present invention, it is possible to wind the wire so as to be in close contact with the to-be-bound object by the operation of pulling back the wire wound around the to-be-bound object, so that it is possible to improve the binding force. In addition, when feeding the wire in the one direction, the load that is applied from the feeding member to the wire does not increase beyond necessity and a decrease in feeding speed of the wire can be suppressed. Further, it is possible to suppress occurrence of buckling of the wire, which is caused when the force of feeding the wire in the forward direction becomes strong.

(2) The binding machine according to (1), where the wire feeding unit includes a pair of the feeding members configured to sandwich the wire and to feed the wire by a rotating operation. A feeding path of the wire that is fed by the wire feeding unit is bent along one feeding member on a downstream side of a portion where the pair of feeding members faces each other with respect to a feeding direction of the wire in the one direction.

(3) The binding machine according to (2), where the one feeding member is located on a bending center-side of the bent feeding path of the wire.

(4) The binding machine according to (2) or (3), where an amount of contact between one feeding member and the wire is switched in accordance with the feeding direction of the wire, on a downstream side of the portion where the pair of feeding members faces each other with respect to the feeding direction of the wire in the one direction.

(5) The binding machine according to (4), wherein when the wire is fed in the one direction on the downstream side of the portion where the pair of feeding members faces each other with respect to the feeding direction of the wire in the one direction, a force of displacing the wire in a direction away from the feeding member is applied, and when the wire is fed in the other direction, a force of displacing the wire in a direction toward the one feeding member is applied.

(6) The binding machine according to any one of (2) to (5), where the one feeding member is made to have a larger diameter than the other feeding member.

(7) The binding machine according to any one of (2) to (6), where the feeding members each have a gear portion formed on an outer periphery, and the pair of feeding members meshes at the gear portions thereof and each has a groove portion formed on the outer periphery in which the wire is introduced.

(8) The binding machine according to (7), includes a regulation part configured to enter the groove portion of the one feeding member and provided on a downstream side at an interval from the portion where the pair of feeding members faces each other with respect to the feeding direction of the wire in the one direction.

(9) The binding machine according to (2), includes a wire guide provided downstream side of the portion where the pair of feeding members faces each other. The wire guide is configured to control an amount of displacement of the wire in directions of contacting and separating from the one feeding member.

(10) The binding machine according to (2), where in a case where the wire is fed in the one direction, a first portion that the wire bends is positioned at upstream side of the portion where the pair of feeding members faces each other, and in a case where the wire is fed in the other direction, the first portion is positioned at downstream side of the portion where the pair of feeding members faces each other.

(11) The binding machine according to (6), includes a support member and an elastic member. The support member is configured to support the other feeding member so as to be movable in directions of contacting and separating from the one feeding member. The elastic member is configured to urge the other feeding member toward the one feeding member.

(12) The binding machine according to (8), includes a second portion provided downstream side of the regulation part, where the second portion is made of a material harder than a material constituting the regulation part. In a case the wire is fed in the other direction, the second portion is configured to slide with the wire.

The invention claimed is:

1. A binding machine comprising:

a main body;

a wire feeding unit configured to feed a wire;

a curl forming unit comprising a curl guide and configured to form a path along which the wire fed by the wire feeding unit is to be wound around a to-be-bound object;

a cutting unit comprising a cutting blade and configured to cut the wire wound on the to-be-bound object; and a binding unit comprising a wire engaging body, the binding unit positioned in the main body and configured to twist the wire wound on the to-be-bound object and cut by the cutting unit, wherein the wire feeding unit comprises a pair of feeding members configured to sandwich the wire and to feed the wire by a rotating operation, wherein an amount of contact between one feeding member of the pair of feeding members and the wire is switched in accordance with a feeding direction of the wire, wherein, as compared to the amount of contact between the one feeding member and the wire in an operation of feeding the wire in one direction and winding the wire around the to-be-bound object, the amount of contact between the one feeding member and the wire in an operation of feeding the wire in other direction, which is opposite to the one direction, and winding the wire on the to-be-bound object is made larger, wherein the one direction is a direction extending from the pair of feeding members toward the curl guide, and wherein a feeding path of the wire that is fed by the wire feeding unit is bent along the one feeding member on a downstream side, in the one direction, of a location where the pair of feeding members face each other with respect to a feeding direction of the wire.

2. The binding machine according to claim 1, wherein the one feeding member is located on a bending center-side of the bent feeding path of the wire.

3. The binding machine according to claim 1, wherein an amount of contact between the one feeding member and the wire is switched in accordance with the feeding direction of the wire, on a downstream side of the location where the pair of feeding members face each other with respect to the feeding direction of the wire in the one direction.

4. The binding machine according to claim 3, wherein when the wire is fed in the one direction on the downstream side of the location where the pair of feeding members face each other with respect to the feeding direction of the wire in the one direction, a force of displacing the wire in a direction away from the one feeding member is applied, and when the wire is fed in the other direction, a force of displacing the wire in a direction toward the one feeding member is applied.

5. The binding machine according to claim 1, wherein the one feeding member of the pair of feeding members has a larger diameter than the other feeding member of the pair of feeding members.

6. The binding machine according to claim 5, comprising a support member and an elastic member, wherein the support member is configured to support the other feeding member so as to be movable in directions of contacting and separating from the one feeding member, and wherein the elastic member is configured to urge the other feeding member toward the one feeding member.

7. The binding machine according to claim 1, wherein the feeding members of the pair of feeding members each have a gear portion formed on an outer periphery, and the pair of feeding members mesh at the gear portions thereof and each has a groove portion formed on an outer periphery in which the wire is introduced.

8. The binding machine according to claim 7, comprising a regulation part comprising a guide surface, the regulation part configured to enter the groove portion of the one feeding member and provided on a downstream side at an interval from the location where the pair of feeding members face each other with respect to the feeding direction of the wire in the one direction.

9. The binding machine according to claim 8, comprising a second portion provided downstream side of the regulation part, where the second portion is made of a material harder than a material constituting the regulation part, wherein in a case the wire is fed in the other direction, the second portion is configured to slide with the wire.

10. The binding machine according to claim 1, comprising a wire guide provided downstream side of the location where the pair of feeding members face each other, wherein the wire guide is configured to control an amount of displacement of the wire in directions of contacting and separating from the one feeding member.

11. The binding machine according to claim 1, wherein in a case where the wire is fed in the one direction, a first portion of the feeding path at which the wire is bent is positioned at the downstream side of the location where the pair of feeding members face each other, and in a case where the wire is fed in the other direction, the first portion of the feeding path is positioned at an upstream side of the location where the pair of feeding members faces each other.

* * * * *